US006154913A

United States Patent [19]

Burton

[11] Patent Number: 6,154,913

[45] Date of Patent: Dec. 5, 2000

[54] FLEXIBLY JOINTED TOILET BRUSH

[75] Inventor: Maximillian P. Burton, New York, N.Y.

[73] Assignee: General Housewares Corp., Terre Haute, Ind.

[21] Appl. No.: 09/226,756

[22] Filed: Jan. 6, 1999

[51] Int. Cl.[7] ..... A46B 9/02

[52] U.S. Cl. ..... 15/160; 15/104.2; 15/143.1; 15/144.1; 15/145; 15/172; 15/176.2; 15/DIG. 5; 15/DIG. 6; 15/164; 403/220; 403/223; D4/128; D4/138

[58] Field of Search ..... 15/104.16, 104.2, 15/106, 143.1, 144.1, 145, 144.2, 159.1, 160, 164, 172, 176.2, DIG. 5, DIG. 6; 403/220, 223; D4/127, 128, 130, 132–134, 138

[56] References Cited

U.S. PATENT DOCUMENTS

| | | | |
|---|---|---|---|
| D. 99,110 | 3/1936 | Bickel | D4/134 |
| D. 266,035 | 9/1982 | Thompson | D4/128 |
| D. 270,669 | 9/1983 | Cassai et al. | D28/7 |
| D. 315,833 | 4/1991 | Brazis | D4/138 |
| D. 394,353 | 5/1998 | Berti | D4/138 |
| 750,357 | 1/1904 | Gibbons | 15/160 |
| 1,154,369 | 9/1915 | Browning | 15/160 |
| 2,980,457 | 4/1961 | Page | 15/245 |
| 3,451,723 | 6/1969 | Marks | 300/21 |
| 4,756,039 | 7/1988 | Pardo | 15/160 |
| 4,776,456 | 10/1988 | Lewis | 206/15.3 |
| 4,819,291 | 4/1989 | Gunjian | 15/104.2 |
| 4,861,179 | 8/1989 | Schrepf et al. | 401/129 |
| 5,240,339 | 8/1993 | DeForest et al. | 401/207 |
| 5,333,345 | 8/1994 | O'Donnell | 15/144.1 X |
| 5,384,930 | 1/1995 | Uno | 15/159.1 |
| 5,440,775 | 8/1995 | Banks | 15/106 |
| 5,482,059 | 1/1996 | Miraglia | 132/218 |
| 5,613,262 | 3/1997 | Choy-Maldonado | 15/160 |
| 5,878,459 | 3/1999 | McParland | 15/160 X |

FOREIGN PATENT DOCUMENTS

| | | | |
|---|---|---|---|
| 199835 | 11/1986 | European Pat. Off. | 15/DIG. 5 |
| 329938 | 8/1989 | European Pat. Off. | 15/160 |
| 375634 | 6/1990 | European Pat. Off. | 15/160 |
| 3525194 | 1/1987 | Germany | 15/160 |

*Primary Examiner*—Mark Spisich
*Attorney, Agent, or Firm*—Seyfarth Shaw

[57] ABSTRACT

A toilet brush is provided which includes an elongated handle having a first axis, a brush head having a second axis, and a flexible joint flexibly connecting the handle to the brush head. The joint is threadedly connected to at least one of the brush head and the handle, whereby the joint allows the second axis of the brush head to be deflected with respect to the first axis of the handle. The brush head may also include first and second sets of segregated bristles. The second set of bristles being longer, stiffer and disposed closer to the handle than the first set of bristles.

18 Claims, 3 Drawing Sheets

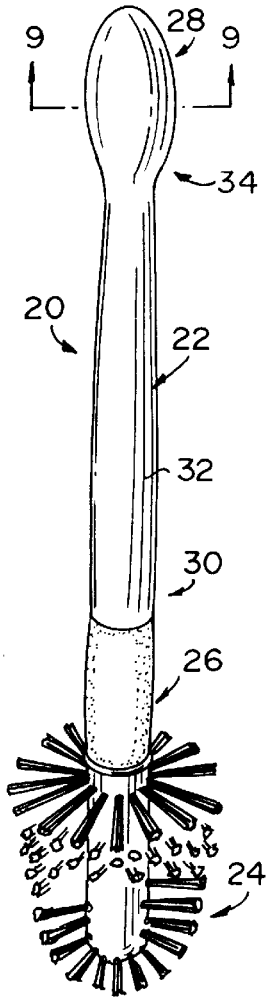
FIG. 1
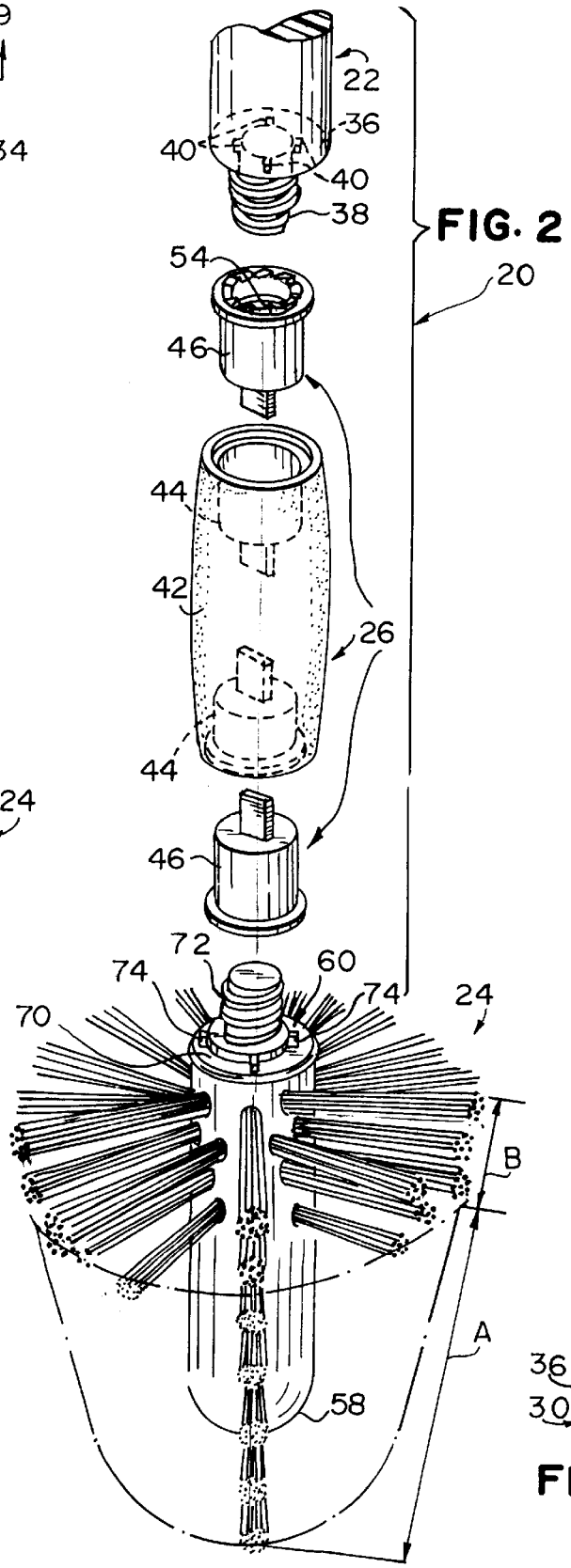
FIG. 2
FIG. 9
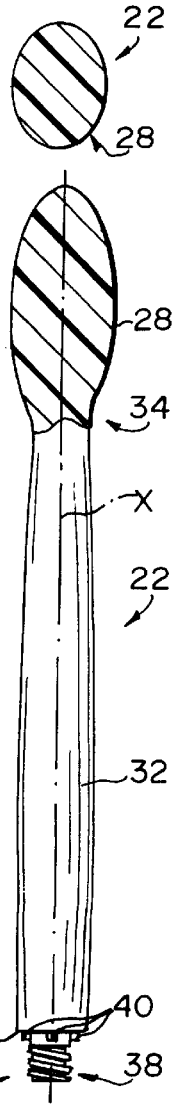
FIG. 8

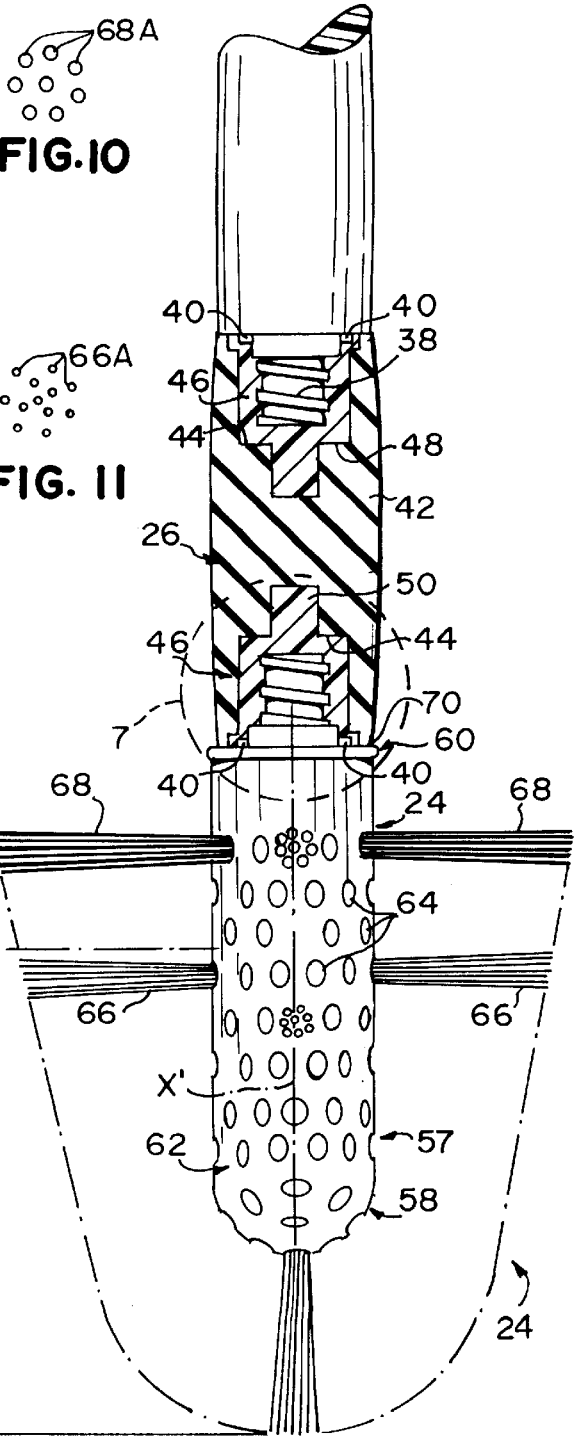
FIG. 10
FIG. 11
FIG. 3
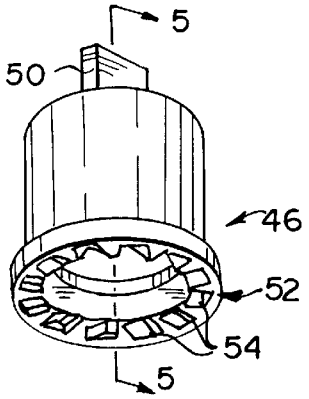
FIG. 4
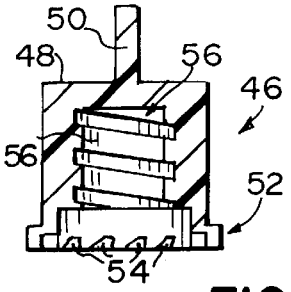
FIG. 5
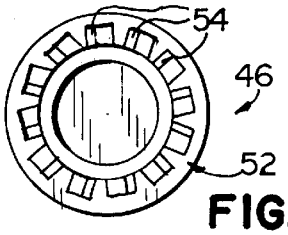
FIG. 6
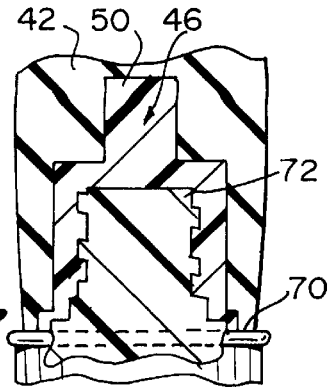
FIG. 7

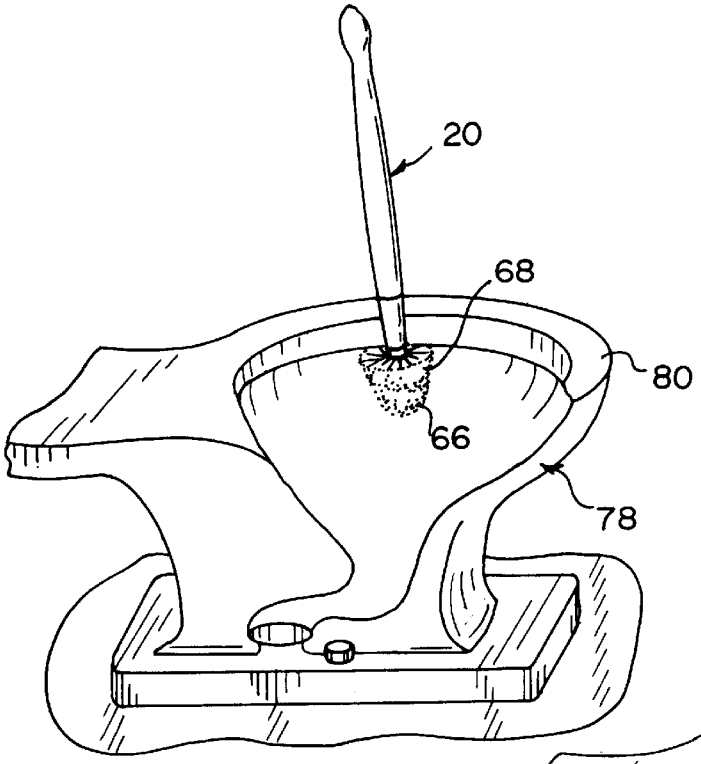
FIG. 12
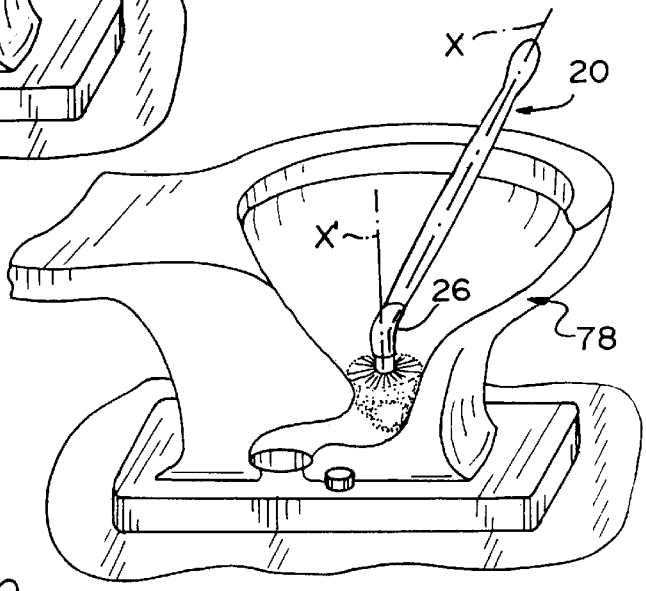
FIG. 13
FIG. 14
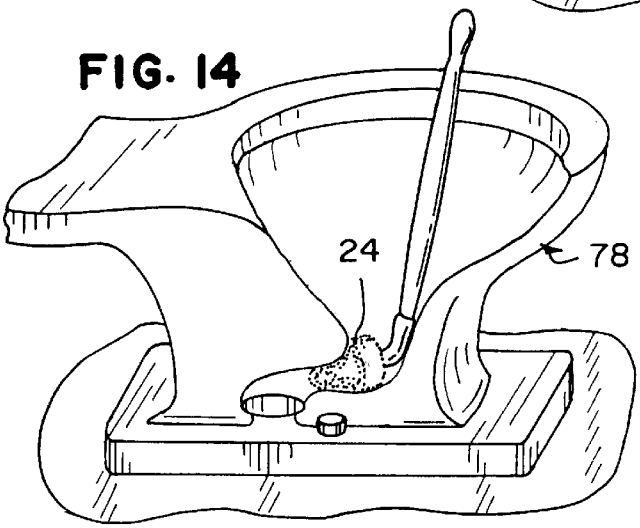

FLEXIBLY JOINTED TOILET BRUSH

BACKGROUND OF THE INVENTION

1. Field of the Invention

This invention relates to toilet brushes, and more particularly to flexibly jointed toilet brushes.

2. Description of the Prior Art

In the past, toilet brushes have been provided to clean the inner portion of the toilet bowl. These brushes usually consisted of an elongated handle integral with or rigidly connected to a brush head having cleaning bristles. These brushes suffer from several problems. First, the brush heads and bristles are not shaped and dimensioned to easily clean under the rim of the toilet bowl. Second, the rigidity of the handle/brush connection, as well as the size and shape of the bristle configuration, does not allow a user to easily manipulate these brushes to clean portions of the bowl including the now smaller orifices of the new low flush toilets. Manipulation of these brushes may in fact cause the handles of these brushes to break or otherwise be damaged. Finally, the handles of these brushes often would rotate or slip in a user's hand making cleaning more difficult.

SUMMARY OF THE INVENTION

It is a general object of the invention to provide an improved toilet brush which avoids the disadvantages of prior toilet brushes while affording additional structural and operational advantages.

An important feature of the invention is the provision of a toilet brush which is of a relatively simple and economical construction.

Another feature of the invention is the provision of a toilet brush of the type set forth having a brush head shaped, dimensioned and constructed to easily and efficiently clean under the rim of a toilet bowl.

A still further feature of the invention is the provision of a toilet brush of the type set forth whose head can be deflected relative to its handle to allow the brush head to better reach and clean the different portions of the toilet bowl.

Another feature of the invention is the provision of a brush of the type set forth whose handle shape conforms to the hand of the user and aids in preventing the handle from twisting in use.

Certain ones of these and other features of the invention may be attained by providing a toilet brush which includes an elongated handle having a first axis, a brush head having a second axis, and a flexible joint flexibly connecting the handle to the brush head. The joint is threadedly connected to at least one of the brush head and the handle, whereby the joint allows the second axis of the brush head to be deflected with respect to the first axis of the handle.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 1 is a perspective view of the toilet brush of the present invention;

FIG. 2 is an enlarged, exploded perspective view of FIG. 2;

FIG. 3 is a fragmentary side elevational view of the brush at FIG. 1 in partial section;

FIG. 4 is a perspective view of one of the connectors of the joint;

FIG. 5 is a sectional view taken generally along the line 5—5 of FIG. 4;

FIG. 6 is a bottom plan view of the connector of FIG. 5;

FIG. 7 is an enlarged, sectional view illustrating the connectors between the joint and the brush head;

FIG. 8 is a side elevation view of the handle of the brush;

FIG. 9 is sectional view of the handle of FIG. 1, taken along the line 9—9 therein;

FIGS. 10–11 are schematic views of portions of the two sets of bristles in the head; and FIGS. 12–14 are schematic illustrations of the brush in use.

DETAILED DESCRIPTION OF THE PREFERRED EMBODIMENT

As seen in FIG. 1, a toilet brush 20 is provided. The toilet brush 20 includes an elongated handle 22, a brush head 24 and a flexible joint 26 flexibly connecting the brush head 24 to the handle 22.

The handle 22 can be formed out of a variety of materials including plastic, such as polypropylene. As seen in FIGS. 1 and 8, the handle 22 has a longitudinal axis and first and second ends 28, 30. The first end 28 is shaped and dimensioned to fit comfortably in the hand of a user. In that regard, the first end 28 is substantially elliptical in both longitudinal (FIG. 8) and transverse cross section (FIG. 9). When a user holds the handle by forming a fist around the first end 28, the elliptical transverse cross section aids in preventing rotation of the handle in use as the internal portion of the user's fist conforms to the shape of the first end 28.

The elliptical longitudinal cross section of the handle 22 provides a smooth continuous surface without sharp corners which fits comfortably in a user's hand without pinching the user's hand.

The handle 22 also includes a substantially frustoconical-shaped central portion 32 connected to the first and second ends 28, 30. The central portion 32 increases in diameter from the first end 28 towards the second end 30. As seen in FIGS. 1 and 8, the first end 28 has portions which extend radially outwardly from the axis of the handle 22 a greater distance than the central portion 32 at a junction 34 between the first end 28 and central portion 32. The first end 28 thus forms a knob which when held in a user's hand, allows the user to maintain the first end 28 in his grasp and resist longitudinal forces in a direction from the first end 28 to the second end 30 which may be encountered in use.

The second end 30 of the handle 22 includes a substantially planar surface 36 (FIG. 2), a male threaded stud 38 and four locking tabs 40 projecting from the planar surface 36.

As seen in FIGS. 2 and 3, the flexible joint 26 is elongated and includes a flexible body 42 formed of a flexible material, such as an elastomer or rubber, including a plastic sold under the tradename Santoprene. The body 42 has two cavities 44 respectively at its longitudinal ends.

The joint 26 also includes two connectors 46, which preferably are formed of a plastic such as polypropylene. The interior of the cavities 44 are shaped substantially identical to the exterior of the connectors 46. The connectors 46 are fixedly disposed in the cavities 44. A preferred method of assembling the flexible joint 26 includes disposing the previously formed connectors 46 in a mold and injection molding the material forming the flexible body 42 about the connectors 46 creating a bond between the two.

The connectors 46 are cup-shaped having a planar bottom surface 48 and a rectangular tab 50 projecting therefrom. When the connectors 46 are disposed in a cavity 44, each of the tabs 50 projects from the bottom surface 48 toward the center of the flexible body 42 (FIG. 3). Each of the connectors 46 has an end which includes a rim 52 (FIGS. 4–6) having a plurality of locking receptacles 54 disposed therein and discussed further below. Each connector 46 includes a female threaded cavity 56 (FIG. 5).

As seen in FIG. 2, the brush head 24 includes a base 57 preferably formed of a plastic such as polypropylene. The base 57 has a first end 58 includes a substantially bullet shaped base portion 62 and a plurality of cavities 64 (FIG. 3) circumferentially and axially disposed about its outer peripheral surface. A first set of bristles 66 formed by a plurality of bristles 66A is disposed in each of the cavities 64 of a zone A. A second set of bristles 68 formed by a plurality of bristles 68A is disposed in the remaining cavities 64 in a zone B, which, as shown in FIG. 3, includes the three bottommost rows of cavities 64 closest to second end 60. The first and second sets of bristles 66, 68 form a bullet shaped configuration.

The second set of bristles 68 extend radially outwardly from the base 57 a greater distance than the first set of bristles 68. The bristles 68A of the second set of bristles 68 are stiffer than the bristles 66A of the first set of bristles 66. As seen in FIGS. 10 and 11, the bristles 68A have a larger diameter than the bristles 66A.

The second end 60 of the base 57 includes a planar surface 70 from which a male threaded stud 72 and four equally-spaced locking tabs 74 (only three shown in FIG. 2) extend.

The brush 20 is assembled as follows. The threaded stud 38 of the handle 22 is inserted and secured into the locking receptacles 54 of one of the connectors 46. When the threaded stud 38 is threaded fully, the four locking tabs 40 are respectively disposed in four associated locking receptacles 54 of the connectors 46 which aid in preventing the brush head 24 from rotating relative to the handle 22, or vice versa.

Similarly, the threaded stud 72 of the base 57 of the brush head 24 is inserted and secured into the locking receptacles 54 of the other connector 46. When the threaded stud 72 is fully threaded, the locking tabs 74 are respectively disposed in four associated locking receptacles 54 of the connector 46 which aids in preventing the brush head 24 from rotating relative to the brush head 24 or vice versa.

FIGS. 12–14 illustrate the brush 20 in use with a toilet bowl 78. As seen in FIG. 12, the second set of bristles 68 have a length long enough and are stiff enough to clean under a rim 80 of the toilet bowl 78.

As seen in FIGS. 13 and 14, the flexible joint 26 allows the axis of the base 57 of the brush head 24 to be deflected relative to the axis of the handle 22 to allow the brush head 24 to easily reach and clean the different areas of the bowl 78.

Additionally, as seen in FIG. 14, the bullet-shaped configuration of the first and second set of bristles 66, 68 allow the brush head 24 to reach into and clean the small diameter portions of the bowl 78, such as the flush hole.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A toilet brush comprising:

an elongated handle having a first axis;

a brush head having a second axis and a plurality of bristles projecting from the head in a bullet-shape configuration and shaped and dimensioned for cleaning a toilet bowl; and a flexible joint flexibly connecting the handle to the brush head, the joint threadedly connected to at least one of the brush head and the handle, the joint having an at-rest condition wherein the first and second axes are substantially coaxial and a deflected condition wherein the second axis of the brush head is deflected with respect to the first axis of the handle, the head having a first end connected to the joint and a second terminal end, wherein the bristles adjacent the first end are longer and stiffer than the bristles disposed closer to the second terminal end.

2. The brush of claim 1, wherein the joint includes an elongated elastomeric body having first and second ends, the first end including a first threaded connector, the first threaded connector being threadedly connectable to one of the brush head and the handle.

3. The brush of claim 2, wherein the second end of the joint includes a second threaded connector, wherein the first and second connectors are respectively threadedly connected to the head and handle.

4. The brush of claim 3, wherein the first and second ends of the body respectively form first and second cavities and the first and second connectors are respectively fixedly disposed in the first and second cavities.

5. The brush of claim 4, wherein the first and second connectors are bonded to the body.

6. The brush of claim 4, wherein each of the first and second connectors is cup-shaped and has a bottom wall and a tab projecting from the bottom wall toward the center of the body.

7. The brush of claim 3, wherein the first and second connectors respectively include first and second locking receptacles and the head has a head locking projection disposed in the first locking receptacle and the handle has a handle locking projection disposed in the second locking receptacle, whereby the joint is substantially prevented from rotating with respect to either the handle or the head.

8. The brush of claim 1, wherein the handle has a first end connected to the joint and a second terminal end substantially elliptical in transverse cross-section.

9. The brush of claim 8, wherein the second terminal end of the handle is substantially elliptical in longitudinal cross-section.

10. A toilet brush comprising:

an elongated handle;

a brush bead having an axis, a first free end and a second end coupled to the handle;

a first set of bristles disposed about the axis and coupled to and radially projecting outwardly from the head, all of the bristles of the first set being disposed along an axial extent of the head containing no other bristles; and a second set of bristles segregated from the first set of bristles and disposed about the axis and coupled to and radially projecting outwardly from the head, the second set of bristles being disposed closer to the second end than first set of bristles, each of the bristles of the second set being stiffer than each of the bristles of the first set, the first and second sets of bristles shaped and dimensioned for cleaning a toilet bowl.

11. The brush of claim 10 wherein each bristle of the first set has a first diameter and each bristle of the second set of bristles has a second diameter, the second diameter being greater than the first diameter.

12. The brush of claim 10, wherein the bristles of the second set radially project a greater distance from the axis than the bristles of the first set.

13. The brush of claim 10, wherein the first and second sets of bristles collectively form a bullet-shaped configuration.

14. The brush of claim 10, and further comprising a flexible joint flexibly connecting the handle to the brush head, whereby the joint allows the brush head to be deflected with respect to the handle.

15. The brush of claim 14, wherein the joint includes an elongated elastomeric body having first and second ends including a first and second threaded connectors, the first and second threaded connectors respectively threadedly connected to the brush head and the handle.

16. The brush of claim 15, wherein the first and second ends of the body respectively form first and second cavities and the first and second connectors are respectively fixedly disposed in the first and second cavities.

17. The brush of claim 14, wherein the handle has a first end connected to the joint and a second terminal end which is substantially elliptical in transverse cross-section.

18. The brush of claim 17, wherein the second terminal end of the handle is substantially elliptical in longitudinal transverse cross-section.

* * * * *

UNITED STATES PATENT AND TRADEMARK OFFICE

CERTIFICATE OF CORRECTION

PATENT NO. : 6,154,913
DATED : December 5, 2000
INVENTOR(S) : Burton, Maximillian P.

It is certified that error appears in the above-identified patent and that said Letters Patent is hereby corrected as shown below:

Column 5,
Line 3, "bead" should be -- head --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,154,913
DATED : December 5, 2000
INVENTOR(S) : Burton, Maximillian P.

It is certified that error appears in the above-identified patent and that said Letters Patent is hereby corrected as shown below:

Column 5,
Line 3, "bead" should be -- head --.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*